US005415960A

United States Patent [19]

Fujita

[11] Patent Number: 5,415,960

[45] Date of Patent: May 16, 1995

[54] METHOD OF FABRICATING A PHOSPHOR SCREEN FOR A CATHODE RAY TUBE

[75] Inventor: Kouji Fujita, Kanagawa, Japan

[73] Assignee: Sony Corporation, Tokyo, Japan

[21] Appl. No.: 154,553

[22] Filed: Nov. 19, 1993

[30] Foreign Application Priority Data

Nov. 19, 1992 [JP] Japan ..... 4-310372

[51] Int. Cl.[6] ..... G03C 5/00

[52] U.S. Cl. ..... 430/23; 430/26; 430/29

[58] Field of Search ..... 430/23, 26, 29

[56] References Cited

U.S. PATENT DOCUMENTS 4,772,345 9/1988 Sagow et al. ..... 430/23

FOREIGN PATENT DOCUMENTS 4105297 8/1992 Germany .

OTHER PUBLICATIONS

*Patent Abstract of Japan,* JP-A-01 052 363, vol. 13, No. 254, 13 Jun. 1989 "Formation of Fluorescent Screen of Color . . . ".

*Patent Abstract of Japan,* JP-A-62 234 838, vol. 12, No. 106, 6 Apr. 1988 "Manufacture of Phosphor Film in Color . . . ".

*Primary Examiner*—Steve Rosasco

*Attorney, Agent, or Firm*—Hill, Steadman & Simpson

[57] ABSTRACT

A method for fabricating a phosphor screen of a cathode ray tube which includes the steps of forming a light absorbing pattern on an inner surface of a panel of the cathode ray tube, applying a slurry of first phosphor on the inner surface of the panel, rotating the panel for drying the slurry of first phosphor around a first axis of rotation, exposing the first phosphor selectively so as to form a first phosphor pattern, applying a slurry of second phosphor on the inner surface of the panel, rotating the panel for drying the slurry of second phosphor around a second axis of rotation, exposing the second phosphor selectively so as to form a second phosphor pattern, applying a slurry of third phosphor on the inner surface of the panel, rotating the panel for drying the slurry of third phosphor around a third axis of rotation, and exposing the third phosphor selectively so as to form a third phosphor pattern, wherein the first, second and third axes of rotation are parallel to one another.

4 Claims, 4 Drawing Sheets

METHOD OF FABRICATING A PHOSPHOR SCREEN FOR A CATHODE RAY TUBE

BACKGROUND OF THE INVENTION

1. Field of the Invention

The present invention generally relates to methods for fabricating phosphor screens for cathode ray tubes (CRTs) and, more particularly, is directed to a method for drying phosphor slurries after having coated the phosphor slurries on a panel of the CRT.

2. Description of the Prior Art

An ordinary color CRT for a color television receiver is constituted by a glass bulb formed of a panel and a funnel, a phosphor screen, color selection electrodes and an electron gun or the like. In an ordinary color CRT for a color television receiver, for example, a CRT of a type shown in FIG. 1 employing an aperture grill as color selection electrodes, a glass panel 12 has a side wall (i.e., so-called shirt portion) 12*a* which extends from a panel portion opposing to an image being displayed toward the side wall of the glass panel. In this type of the CRT, a length L1 of the side wall 12*a* is about 20 mm. In contrast, a CRT of a so-called beam index type mounted in a vehicle or a cockpit of an airplane, which is high in luminance, not influenced by earth magnetism and has vibration proof characteristics, employs an index stripe or pattern instead of an aperture grille as color selection electrodes. A glass panel 2 of thebeam index type CRT has a side wall or skirt portion 2*a* whose length L2 is about 5 mm as shown in FIG. 2A, which is shorter than the skirt of the ordinary CRT shown in FIG. 1.

Accordingly, there arises a difference between the ordinary CRT and thebeam index type CRT as described bellow in a process for rotating the panel for drying phosphor slurry by using a far-infrared radiation heater after the coating of the phosphor slurry on the panel. That is, in a case of the ordinary CRT, since the length L1 of the skirt portion 12*a* is sufficiently long, the drying process of the phosphor slurry can be completed without causing an unnecessary or excessive phosphor slurry 14 to flow on a phosphor screen A as shown in FIG. 1 even when the panel is rotated at a speed between 20 and 40 r.p.m.

However, in a case of thebeam index type CRT, since the length L2 of the skirt portion 2*a* is short, the unnecessary phosphor slurry 14 is not completely disposed on the outer portions of the side wall but a part of the unnecessary phosphor slurry 14 flows on a phosphor screen A as shown in FIG. 2B when the panel is rotated at a speed between 20 and 40 r.p.m. like the ordinary CRT. If the rotational speed of the panel is increased to a range of 70 to 150 r.p.m. in order to prevent the unnecessary phosphor slurry from flowing on the phosphor screen, a phosphor slurry of a thick stripe configuration is formed at the center portion of the panel as shown in FIGS. 3 and 4, which results in a defect of vertical stripes 15 on the phosphor screen. In FIG. 4, reference numeral 17 denotes a light absorbing pattern of carbon with a stripe shape and 18 a phosphor pattern of stripe shape. This defect is inconspicuous when only one of the phosphor slurries of red, green and blue is coated on the panel. However, when phosphor slurries corresponding to red, green and blue are coated on the panel, the defect becomes conspicuous such that a vertical stripe line caused by unevenness of luminance due to the presence of the stripe phosphor slurry 15 appears on the screen when the resultant CRT is illuminated. Conventionally, this vertical stripe phosphor slurry has been eliminated by swinging or varying the rotational speed in a range of 20 to 40 r.p.m. This conventional method, however, is disadvantageous in that the mechanism for swinging the rotational speed is expensive.

OBJECTS AND SUMMARY OF THE INVENTION

Therefore, it is an object of the present invention to provide an improved method for fabricating a phosphor screen of a CRT in which the aforementioned shortcomings and disadvantages encountered with the prior art can be eliminated.

More specifically, it is an object of the present invention to provide a method for fabricating a phosphor screen of a CRT which can decrease the thick vertical stripe configuration formed at the center portion of the panel.

As an aspect of the present invention, there is provided a method for fabricating a phosphor screen of a cathode ray tube which includes the steps of forming a light absorbing pattern on an inner surface of a panel of the cathode ray tube, applying a slurry of first phosphor on the inner surface of the panel, rotating the panel for drying the slurry of first phosphor around a first axis of rotation, exposing the first phosphor selectively so as to form a first phosphor pattern, applying a slurry of second phosphor on the inner surface of the panel, rotating the panel for drying the slurry of second phosphor around a second axis of rotation which is parallel to the first axis of rotation, exposing the second phosphor Selectively so as to form a second phosphor pattern, applying a slurry of third phosphor on the inner surface of the panel, rotating the panel for drying the slurry of third phosphor around a third axis of rotation which is parallel to the first axis and the second axis of rotation, and exposing the third phosphor selectively so as to form a third phosphor pattern.

Preferably, the panel is rotated at a rotational speed of 70 to 150 r.p.m.

Further, preferably, the first axis of rotation is spaced more than 2 mm or 3 mm away from the second axis of rotation and the third axis of rotation, respectively.

According to the thus arranged method for fabricating the phosphor screen of the CRT according to the present invention, when the length of the side walls (skirts) of the panel is short like the panel of the beam index type CRT, at least the drying processes of the phosphor slurries corresponding to respective colors such as, for example, red, green and blue or the like after the application processes of these phosphor slurries are performed by rotating the panel at a high speed such that axis of rotation of the panel is displaced at every drying process of the phosphor slurry. As a consequence, the phosphor slurry of the thick stripe configuration formed at the center portion of the panel due to the high speed rotation is spread in the left and right direction and then decreased in thickness, so that the formation of the vertical stripe line or unevenness of luminance at the center portion of the panel becomes inconspicuous, The above and other objects, features, and advantages of the present invention will become apparent from the following detailed description of an illustrative embodiment thereof when read in conjunction with the accompanying drawings, in which like reference numerals are used to identify the same or similar parts in the several views.

DETAILED DESCRIPTION OF THE PREFERRED EMBODIMENT

A method for fabricating a phosphor screen of a CRT according to an embodiment of the present invention will now be described with reference to FIGS. 5 to 7.

Figure 1:
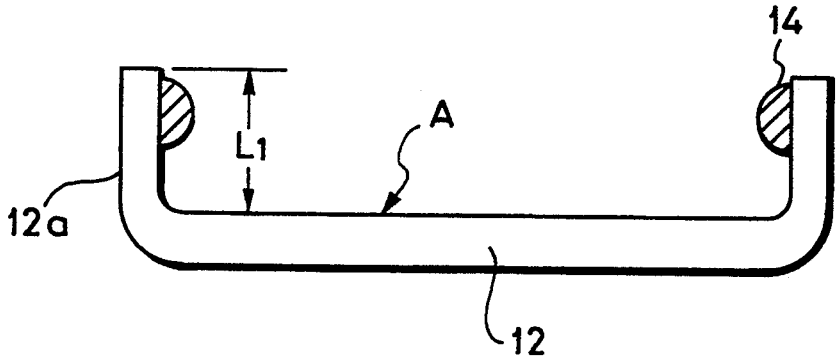
FIG. 1 (PRIOR ART)
FIG. 1 is a schematic sectional view illustrating a panel of an ordinary CRT used to explain the conventional method for fabricating a phosphor screen thereof.
Figure 2A:
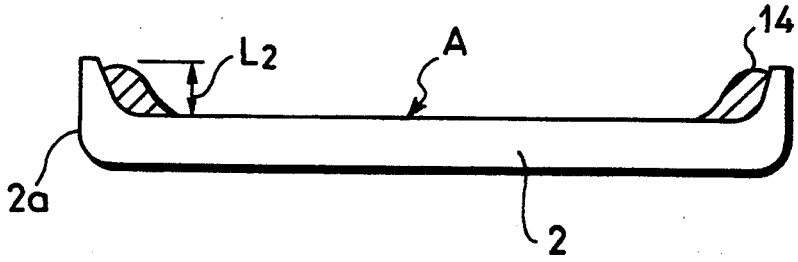
FIG. 2A (PRIOR ART)
FIG. 2A is a schematic sectional view illustrating a panel of an beam index type CRT used to explain the conventional method for fabricating a phosphor screen thereof.
Figure 2B:
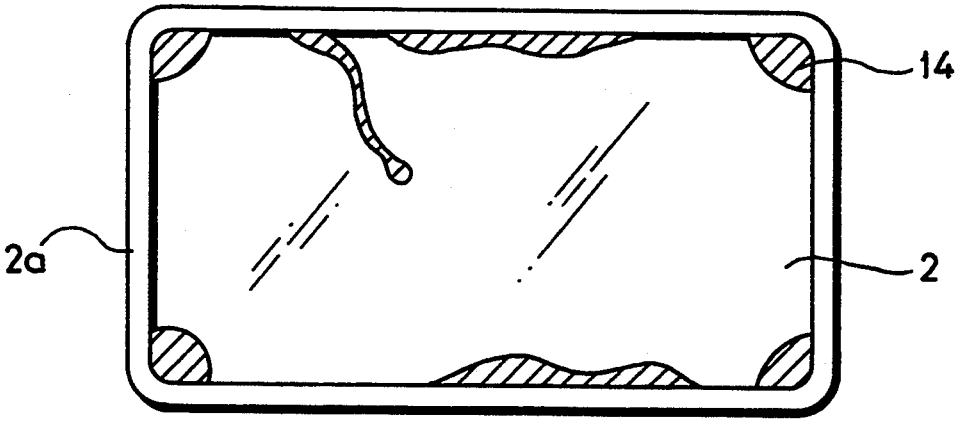
FIG. 2B (PRIOR ART)
FIG. 2B is a schematic plan view illustrating the panel of the beam index type CRT shown in FIG. 2A used to explain the conventional method for fabricating the phosphor screen thereof.
Figure 3:
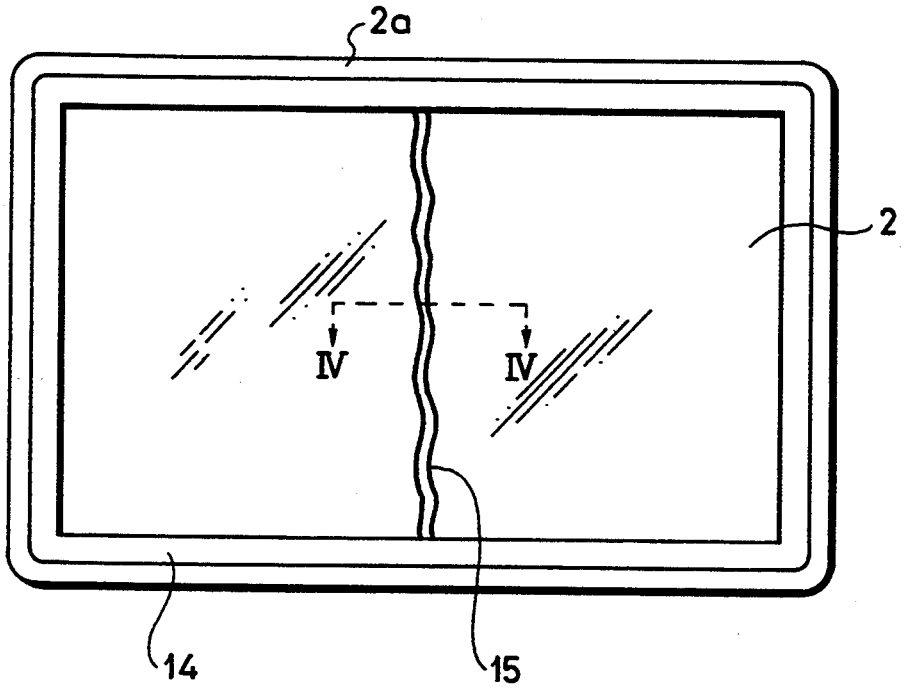
FIG. 3 is a schematic plan view illustrating the panel of the beam indextype CRT shown in FIG. 2A used to explain a defect formed on the panel in a process for fabricating the phosphor screen thereof.
Figure 4:
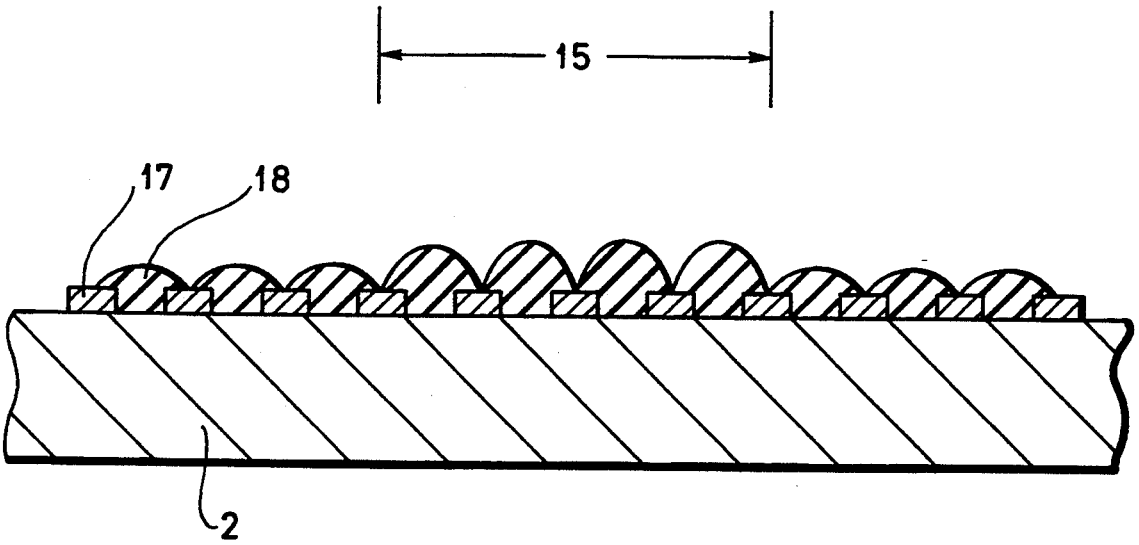
FIG. 4 is a fragmentary sectional view illustrating in an enlarged scale a part of the panel of the beam index type CRT taken along a line IV—IV in FIG. 3.
Figure 5:
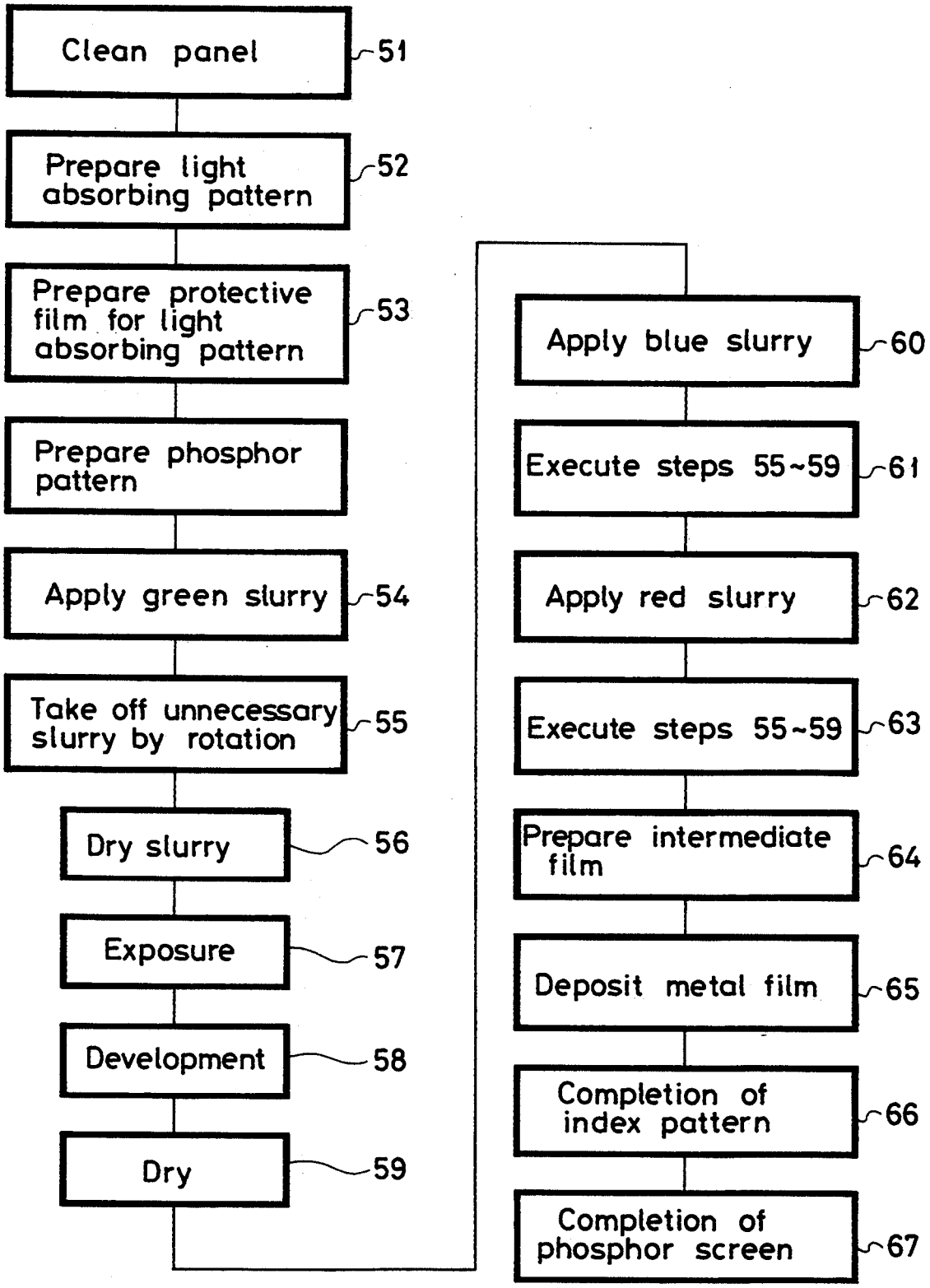
FIG. 5 shows a flowchart used to explain processes for fabricating a phosphor screen according to an embodiment of the present invention.

FIG. 5 shows a flowchart used to explain an embodiment of the processes for fabricating the phosphor screen of a CRT whose panel has short side walls (skirts) according to the present invention. Referring to FIG. 5, first, like the conventional method for preparing the phosphor screen, the panel is cleaned in step 51, then the light absorbing pattern or carbon stripe is prepared on a predetermined area of an inner surface of the panel in step 52 and a protective film for the light absorbing pattern of the carbon stripe is formed in step 53. Thereafter, phosphor slurries respectively corresponding to red, green and blue are coated on the resultant panel. In this embodiment, first, the green phosphor slurry is coated on the inner surface of the panel at a head rotational speed of 7 r.p.m. in step 54, then the unnecessary green phosphor slurry is taken off and the remaining slurry on the panel is dried at a high head rotational speed of 120 r.p.m. in steps 55 and 56. Thereafter, the resultant panel is exposed by ultraviolet rays and developed so as to form a green phosphor pattern in steps 57 and 58, and then the panel is dried at a head rotational speed of 120 r.p.m. in step 59, thereby completing the preparation of the green phosphor pattern or stripe. In this embodiment, the application process of the phosphor slurry in steps 54, 55 and the drying processes in steps 56 and 59 are performed by rotating a table head 1 of a rotary head device shown in FIG. 6 at a predetermined rotational speed.

Figure 6:
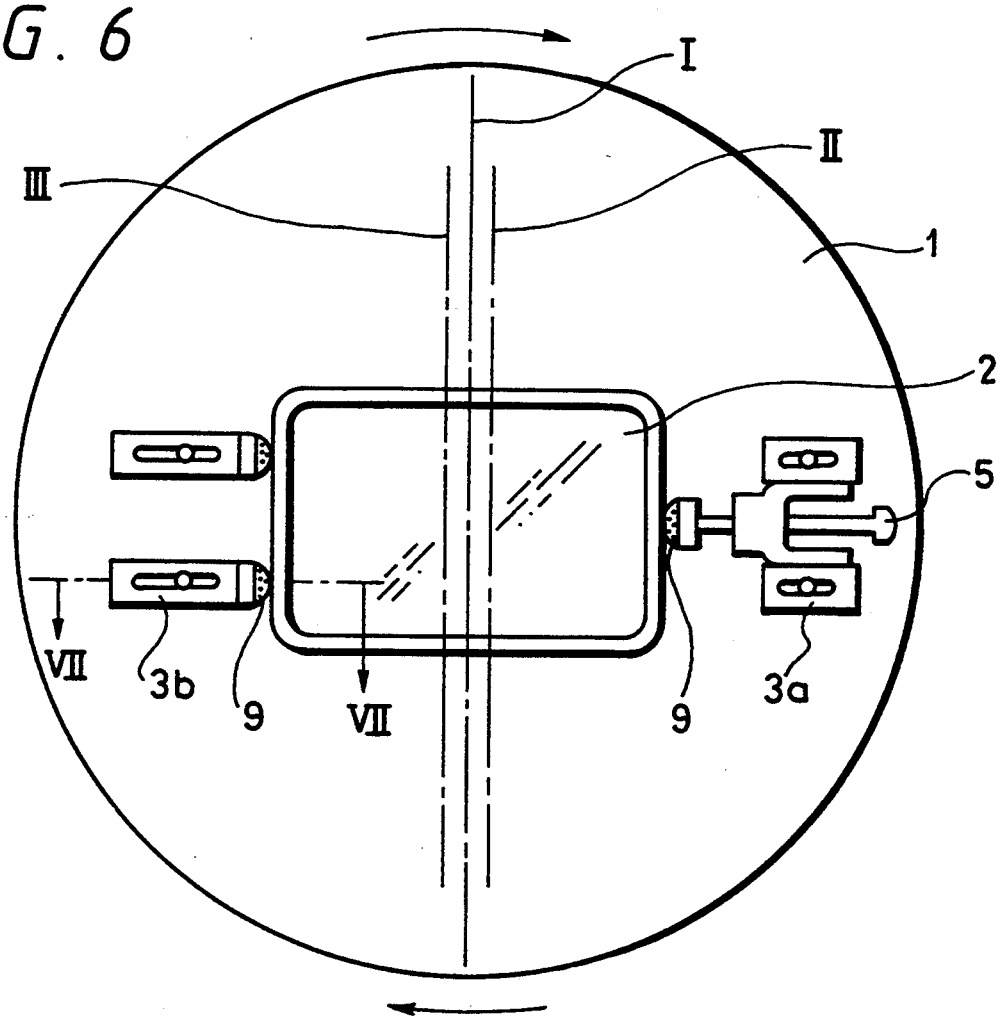
FIG. 6 is a schematic plan view illustrating a rotary head device used to carry out a method of fabricating the phosphor screen according to the present invention.
Figure 7:
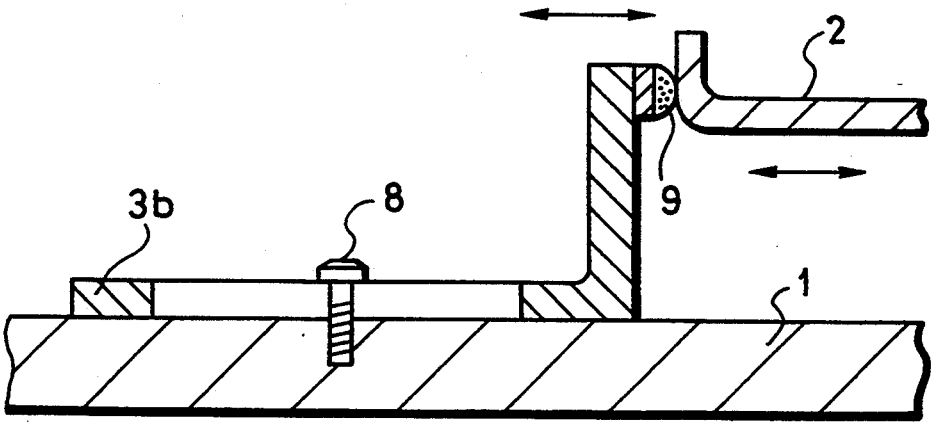
FIG. 7 is a fragmentary sectional view illustrating in an enlarged scale a part of the rotary head device taken along a line VII—VII in FIG. 6.

In this embodiment, as shown in FIG. 6, the panel or panel glass 2 is screwed on a table head 1 by a screw 8 (see FIG. 7) through panel fixing jigs 3*a* and 3*b* and the table head 1 is rotated at a predetermined rotational speed. In FIG. 6, reference numeral 5 denotes a panel chuck. Further, FIG. 7 shows a sectional view of a part of the rotary head device taken along a line VII—VII in FIG. 6. The panel 2 is pressed at its opposite side walls by rubbers 9 which are provided at end portions of the panel fixing jigs 3*a* and 3*b*. In the preparing process of the green phosphor pattern on the panel 2, the green phosphor stripe is completed on a panel table head center shown by a one-dot chain line I in FIG. 6.

Then, the panel on which the green phosphor pattern or stripe has been thus formed is shifted by about 3 mm from the panel table head center I to the right side in FIG. 6 so that the axis of rotation of the panel is on a panel table head center shown by a one-dot chain line II in FIG. 6. Thereafter, the blue phosphor slurry is coated on the panel by rotating the table head 1 at a speed of 7 r.p.m. in step 60, then the unnecessary blue phosphor slurry is taken off and the remaining slurry on the panel is dried in the same manner as steps 55 and 56. Thereafter, the exposing process by the ultraviolet rays, the developing process and the drying process are performed in step 61 in the same manner as the preparation of the green phosphor pattern performed in steps 57 to 59, thereby completing the preparing processes of the blue phosphor pattern or stripe.

Then, the panel on which the blue phosphor pattern or stripe has been thus formed is shifted by about 3 mm from the panel table head center I to the left side in FIG. 6 so that the axis of rotation of the panel is on the panel table head center shown by a one-dot chain line III in FIG. 6. Thereafter, the red phosphor slurry is coated on the panel by rotating the table head 1 at a rotational speed of 7 r.p.m. in step 62, then the unnecessary red phosphor slurry is taken off and the remaining slurry on the panel is dried like steps 55 and 56. Thereafter, the exposing process by the ultraviolet ray, the developing process and the drying process are performed in step 63 in the same manner as the preparation of the green and blue phosphor patterns or stripes performed in steps 57 to 59 and 61, thereby completing the preparing processes of the red phosphor pattern or stripe.

After the green, blue and red phosphor patterns or stripes are thus formed sequentially on the panel, an intermediate film made of acrylic resin or the like is formed on the panel in step 64. Then, a metal film made of aluminum or the like is deposited on the intermediate film in step 65, and then an index pattern is completed and hence the phosphor screen with good characteristics is completed.

According to the phosphor screen thus prepared according to the embodiment, the vertical stripe line caused by unevenness of luminance due to the presence of the stripe phosphor slurry which has been appeared on the conventional phosphor screen can be decreased and becomes inconspicuous.

In the present invention, at least the drying processes of the green, blue and red phosphor slurries after the coating processes of these phosphor slurries may be performed by shifting the axis of rotation of the panel at every drying process of the phosphor slurry.

As set out above, according to the present invention, the phosphor slurry of the thick vertical stripe configuration formed at the center portion of the panel due to the high speed rotation is spread to a direction perpendicular to the panel table head center and then decreased in thickness, so that the vertical stripe line caused by unevenness of luminance due to the presence of the stripe phosphor slurry appearing at the center portion of the panel becomes inconspicuous and hence the unevenness of luminance can be improved to a sufficient good level. Further, since the apparatus for preparing the phosphor screen according to the present invention is simple in constructions, the present invention is advantageous in that the cost of the preparing apparatus is cheap when compared with the conventional apparatus using the mechanism for swinging the rotational speed of the panel.

Having described a preferred embodiment of the invention with reference to the accompanying drawings, it is to be understood that the invention is not limited to that precise embodiment and that various changes and modifications could be effected therein by one skilled in the art without departing from the spirit or scope of the invention as defined in the appended claims.

What is claimed is:

1. A method for fabricating a phosphor screen of a cathode ray tube comprising the steps of:

forming a light absorbing pattern on an inner surface of a panel of a cathode ray tube;

applying a slurry of first phosphor on said inner surface of said panel;

rotating said panel for drying said slurry of first phosphor around a first axis of rotation normal to said surface;

exposing said first phosphor selectively so as to form a first phosphor pattern;

applying a slurry of second phosphor on said inner surface of said panel;

rotating said panel for drying said slurry of second phosphor around a second axis of rotation which is parallel to said first axis of rotation;

exposing said second phosphor selectively so as to form a second phosphor pattern;

applying a slurry of third phosphor on said inner surface of said panel;

rotating said panel for drying said slurry of third phosphor around a third axis of rotation which is parallel to said first axis of rotation; and exposing said third phosphor selectively so as to form a third phosphor pattern.

2. A method for fabricating a phosphor screen of a cathode ray tube according to claim 1, wherein a rotational speed in said step of rotating said panel is 70 to 150 r.p.m.

3. A method for fabricating a phosphor screen of a cathode ray tube according to claim 1, wherein said first axis of rotation is spaced more than 2 mm away from said second axis of rotation and said third axis of rotation, respectively.

4. A method for fabricating a phosphor screen of a cathode ray tube according to claim 1, wherein said first axis of rotation is spaced more than 3 mm away from said second axis of rotation and said third axis of rotation, respectively.

* * * * *